US009041540B2

(12) United States Patent
An et al.

(10) Patent No.: US 9,041,540 B2
(45) Date of Patent: May 26, 2015

(54) RADIO FREQUENCY IDENTIFICATION TAG GRIPPER DEVICE

(71) Applicant: International Business Machines Corporation, Armonk, NY (US)

(72) Inventors: Wen Hao An, Beijing (CN); Bo Gao, Beijing (CN); Peng Gao, Beijing (CN); Wei Sun, Beijing (CN); Xi Sun, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 92 days.

(21) Appl. No.: 13/778,388

(22) Filed: Feb. 27, 2013

(65) Prior Publication Data

US 2013/0222136 A1 Aug. 29, 2013

(30) Foreign Application Priority Data

Feb. 29, 2012 (CN) ..... 2012 1 0050307

(51) Int. Cl.
*G08B 13/14* (2006.01)
*G08B 13/24* (2006.01)

(52) U.S. Cl.
CPC ..... *G08B 13/2465* (2013.01); *G08B 13/2434* (2013.01); *G08B 13/2448* (2013.01)

(58) Field of Classification Search
CPC ..... G08B 13/2417; G08B 13/2434; G08B 13/2448; G08B 13/2465; G06K 19/07749; G06K 19/07798; G06K 19/07345; G06K 19/0723
USPC ..... 340/572.3, 572.1, 10.1; 235/492
See application file for complete search history.

(56) References Cited

U.S. PATENT DOCUMENTS

| | | | | |
|---|---|---|---|---|
| 7,049,962 | B2 | 5/2006 | Atherton et al. | |
| 7,280,044 | B2 | 10/2007 | Kubby | |
| 2006/0170534 | A1* | 8/2006 | Arneson et al. | 340/10.2 |
| 2007/0170332 | A1* | 7/2007 | Akerstedt et al. | 248/313 |
| 2007/0247317 | A1* | 10/2007 | Farrell | 340/572.3 |
| 2009/0035104 | A1* | 2/2009 | Onishi et al. | 414/222.13 |
| 2011/0253715 | A1* | 10/2011 | Phaneuf et al. | 220/212 |
| 2011/0285507 | A1* | 11/2011 | Nelson | 340/10.1 |

* cited by examiner

*Primary Examiner* — Thomas Mullen
(74) *Attorney, Agent, or Firm* — Penny L. Lowry; Jeff Tang

(57) ABSTRACT

The present invention provides a radio frequency identification tag gripper device, the technical scheme including: a first gripper portion; a second gripper portion, which generates a gripping force together with the first gripper portion; a radio frequency identification tag, a circuit portion of which is divided into at least a first section and a second section, an upper surface of the first section and a lower surface of the second section being coated with strong glue, wherein the upper surface of the first section is used to bond with a grip surface of the first gripper portion when gripped tightly, and the lower surface of the second section is used to produce a coupling force with a surface of the gripped object when gripped tightly. Utilizing the technical solution of the present invention, it is possible to further improve the security of monitoring of the radio frequency identification tag.

14 Claims, 6 Drawing Sheets

RADIO FREQUENCY IDENTIFICATION TAG GRIPPER DEVICE

CROSS-REFERENCE TO RELATED APPLICATION

This application claims priority under 35 U.S.C. §119 from Chinese Patent Application No. 201210050307.3 filed Feb. 29, 2012, the entire contents of which are incorporated herein by reference.

BACKGROUND OF THE INVENTION

The present invention relates to the field of radio frequency identification tag gripper devices. More specifically, to a gripper device which can damage the radio frequency identification (RFID) tag when it is opened.

An RFID tag is always attached to an object in order to monitor that object.

An entire RFID tag monitoring system generally includes a reader, an RFID tag and an application software system. The RFID tag includes coupling elements and a chip. Each RFID tag has a unique radio frequency code and it is attached to an object for identifying the target subject. After the RFID tag goes into a magnetic field, it receives radio frequency signals from the reader and sends out product information stored in the chip. The product information stored in the chip is sent out either by the energy obtained by an induced current (Passive Tag) or the RFID tag actively sends a signal of a certain frequency (Active Tag). The reader reads and decodes the information and then sends the information to the application software system for related data processing.

With regard to a significant object, it is desirable to not only provide the information related to the object by the RFID tag attached thereto, but also to monitor the presence of the object by monitoring the presence of the attached RFID tag. Therefore, in order to prevent the action of artificially taking off the tag and taking away the object, it is necessary that any attempt to remove the RFID tag will result in damage to the tag. Further, with regard to some objects, it is necessary to ensure that pollution or damage to the object itself is avoided when the damaged tag is removed.

In prior art, however, the RFID tag is generally pasted directly onto the object. Although the action of removing the RFID tag may lead to tag damage, damage to the tag is not guaranteed. Moreover, there is a possibility that the RFID tag is taken off due to its exposure to the outside.

Therefore, improvements to prior art are desired to solve the above-mentioned problems in the prior art.

SUMMARY OF THE INVENTION

Accordingly, one aspect of the present invention provides a radio frequency identification tag gripper device, including: a first gripper portion; a second gripper portion wherein the second gripper generates a gripping force together with the first gripper portion; and a radio frequency identification tag a circuit portion of which is divided into at least a first section and a second section, an upper surface of the first section and a lower surface of the second section being coated with strong glue, wherein the upper surface of the first section is used to bond with a grip surface of the first gripper portion when gripped tightly, and the lower surface of the second section is used to produce a coupling force with a surface of a gripped object when gripped tightly.

Another aspect of the present invention provides an object monitoring method using the gripper device, the method including the steps of: monitoring in real-time an object gripped by the radio frequency identification tag gripper device to determine whether a signal of the radio frequency identification tag can be detected; and adopting a security measure in response to the signal of the radio frequency identification tag not being detected.

By employing the device provided by the present invention, a circuit portion of the radio frequency identification tag will be damaged when the radio frequency identification tag gripper device is opened.

BRIEF DESCRIPTION OF THE DRAWINGS

FIG. 3 collectively shows various divisions of a radio frequency identification tag according to embodiments of the present invention shown as FIG. 3A, FIG. 3B, and FIG. 3C as follows:

DETAILED DESCRIPTION OF THE PREFERRED EMBODIMENTS

Hereinafter, preferred implementations of the present disclosure will be described in more detail with reference to attached drawings. Although the preferred implementations of the present disclosure are shown in the attached drawings, it should be understood that the present disclosure can be realized in various forms and should not be limited by the implementations described herein. On the contrary, these implementations are provided for the purpose of making the present disclosure more apparent and integral and conveying the entire scope of the present disclosure to those skilled in the art.

Figure 1:
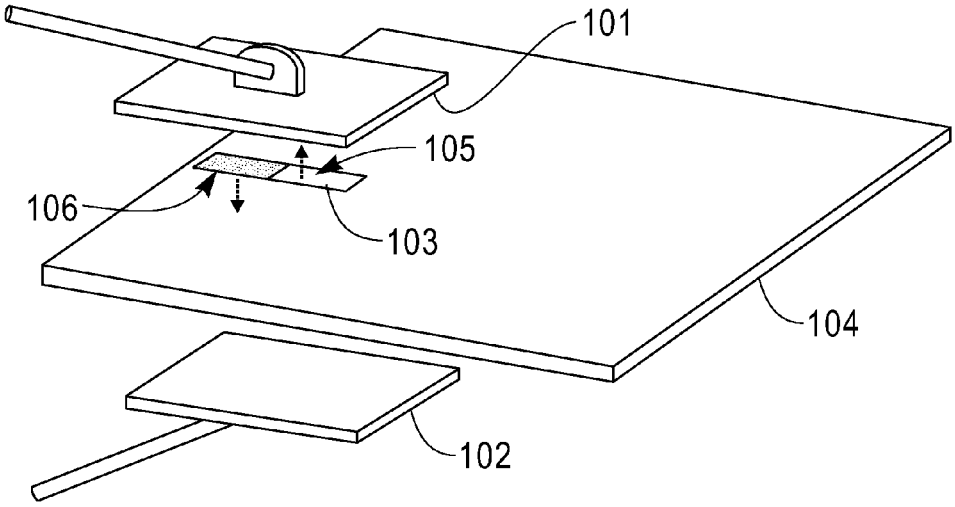
FIG. 1 is an exploded view of a radio frequency identification tag gripper device according to an embodiment of the present invention.
Figure 6:
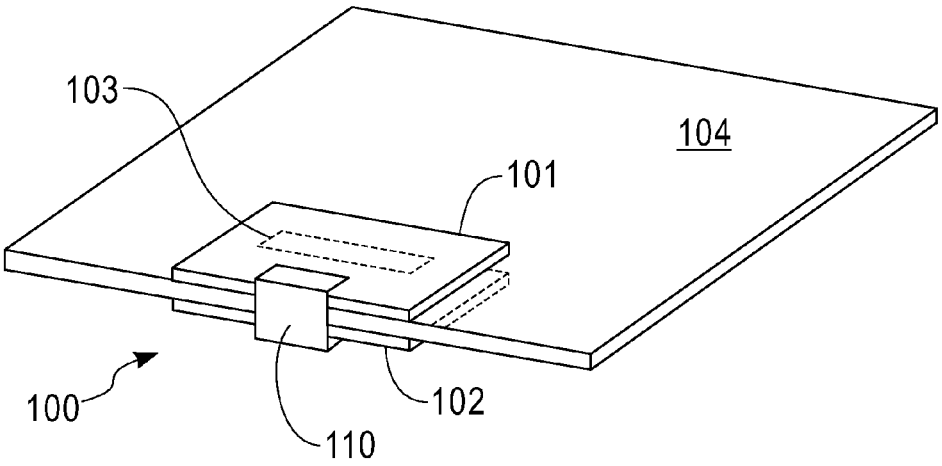
FIG. 6 is a radio frequency identification tag gripper device according to an embodiment of the present invention.

FIG. 1 (exploded view) and FIG. 6 illustrate a radio frequency identification (RFID) tag gripper device 100 provided according to embodiments of the present application, mainly including the following portions:

a first gripper portion 101;

a second gripper portion 102, which is coupled to the first gripper portion 101 and generates a gripping force when it grips tightly. The coupling relationship between the gripper portions can be achieved by any specific structure 110 in prior art, for example, by employing a contact manner such as an elastic device, a lock-up device, etc., or by employing a non-contact manner such as a magnetic force. The grip surfaces of the first gripper portion 101 and the second gripper portion 102 can be planes, which can function as a protection for the RFID tag. Those skilled in the art can also select a grip surface with an appropriate shape so as to match the shape of the gripped object 104 according to requirements.

An RFID tag 103, a circuit portion of which is divided into at least a first section 105 and a second section 106, is further included. The upper surface of the first section 105 and the lower surface of the second section 106 are coated with strong glue, wherein the upper surface of the first section 105 is used to bond with the first gripper portion 101 when gripped tightly, and the lower surface of the second section 106 is used to produce a coupling force with the surface of the gripped object 104 when gripped tightly. Glue with a viscosity larger than 1000 centipoises (cps) is defined as the strong glue and the viscosity of the strong glue can be measured by a Brookfield viscometer.

In FIG. 1, the lower surface of the second section 106 is used to bond directly with the surface of the gripped object 104 to produce a coupling force when gripped tightly. The lower surface of the second section 106 can also bond in an indirect manner with the surface of the gripped object 104 in this embodiment of the invention.

In order to advance reliability, a second RFID tag (not shown in the figure) can also be included in another embodiment, and the circuit portion of the second RFID tag is similarly divided into at least two sections, wherein the upper surface of one section and the lower surface of the other section are coated with the strong glue. One surface of the second RFID tag coated with glue is used to bond with the second gripper portion 102 when gripped tightly, while the other surface coated with glue is used to produce a coupling force with the surface of the gripped object 104 when gripped tightly.

In one embodiment of the invention, the gripped object 104 shown in FIG. 1 is a paper document. Those skilled in the art can apply the grip device to any object and/or they can make adaptive changes to the grip surfaces of the gripper portions to ensure a close contact between the RFID tag and the gripped object 104.

Utilizing the physical structure described in the embodiment shown in FIG. 1, when the RFID tag gripper device is opened, the first gripper portion 101 drives the first section of the RFID tag 103 by the strong glue. Because there is a coupling force between the second section of the RFID tag 103 and the gripped object 104, an extending or a bending occurs on the RFID tag that results in damage. Accordingly, a "one-off" feature of the tag is used to prevent a significant object from being lost or stolen. That is, once an RFID tag gripper device is opened, the tag is automatically damaged and then an alarm is triggered by loss of a tag detection signal. This avoids actions such as intentional damage, removing, stealing, etc. against the tag.

Figure 2:
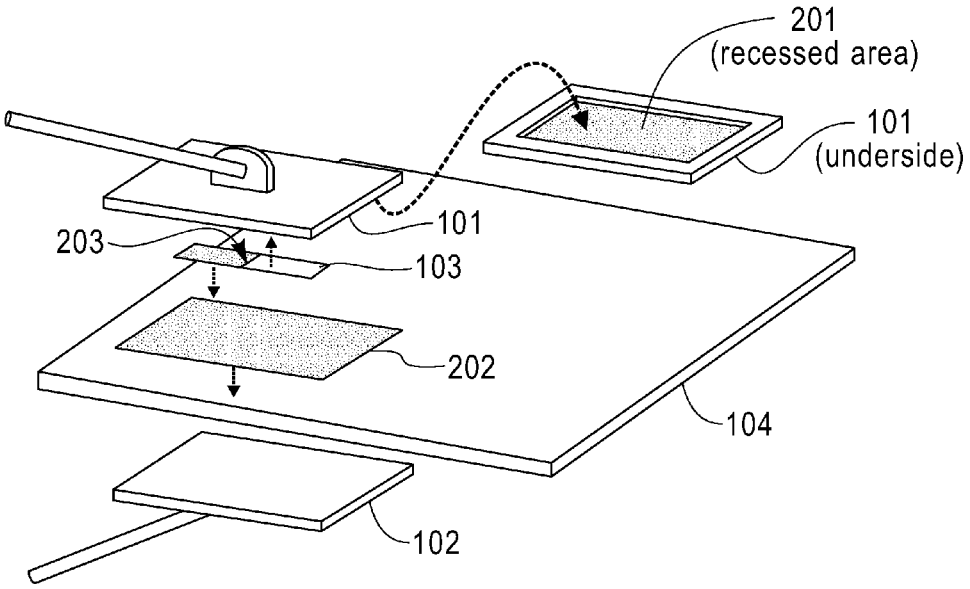
FIG. 2 is an improved radio frequency identification tag gripper device in another embodiment of the present invention.

FIG. 2 illustrates an improved RFID tag gripper device in another embodiment, which further includes the following portions on the basis of FIG. 1:

A groove (recessed area) 201 placed on the grip surface of the first gripper portion 101 used to accommodate the RFID tag 103 so that the grip surface of the first gripper portion 101 and the gripped object 104 can be closely joined. The gripper device and the RFID tag embedded therein are integrated together so that the risk of removing the RFID tag can be prevented in tracking and monitoring objects such as documents.

A slice of material 202, which can be a slice of a plastic material in this embodiment, is coated with weak glue on one surface for bonding on the gripped object 104. The slice is located between the gripped object 104 and the RFID tag 103, wherein a glue-free surface of the slice 202 contacts with the RFID tag and thus they are bonded together by the strong glue. When the manner shown in FIG. 1 is adopted, the RFID tag is directly bonded on the gripped object 104 by the strong glue, which leads to damage or pollution of the surface of the gripped object 104. When the implementation shown in FIG. 2 is adopted, the lower surface of the second section of the RFID tag 103 is used to indirectly bond with the surface of the gripped object 104 through the slice 202 to produce a coupling force when it is gripped tightly. The adopted weak glue can not only provide sufficient bonding force, but can also make the damaged RFID tag more readily removed after the gripper device is opened. In this embodiment, the viscosity of weak glue can be defined as 300-600 cps. When the slice 202 is employed, the groove 201 can also be used to accommodate the slice 202.

A breakable section 203, by which the RFID tag can be divided into multiple sections in order to facilitate damage to the RFID tag, is further included. In one embodiment, the breakable section is in a form of a cut line, which crosses the circuit portion of the RFID tag and divides the RFID tag into the above-mentioned first and second sections, so that the circuit section of the RFID tag can be easily damaged along the cut line when the RFID tag is bent. It should be noted that cut lines are required to avoid elements or electronic circuitry sections in the circuit when it crosses the circuit portion to ensure that the normal functions of the RFID tag are unaffected when the RFID tag is not bent. The cut line can be formed by employing a manner such as an impressed trace or a dashed incision.

Those skilled in the art can realize that one of the groove 201, the slice 202 and the breakable section 203 or any combination thereof can be applied in the RFID tag gripper device.

Figure 3A:
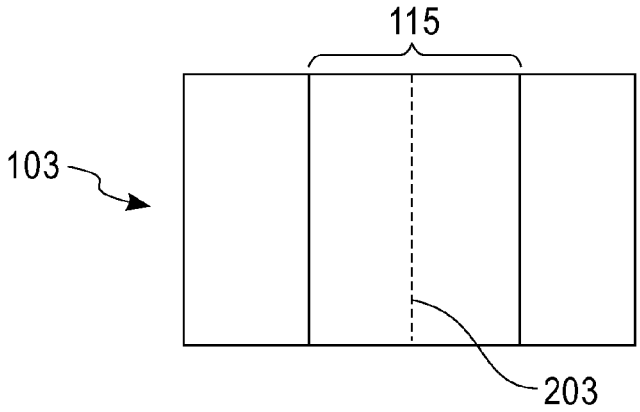
FIG. 3A shows placing the breakable section at the location of a straight line.
Figure 3B:
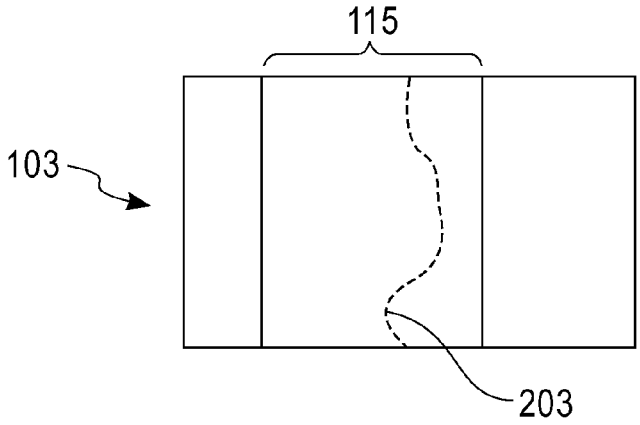
FIG. 3B shows placing the breakable section at the location of a curved line.
Figure 3C:
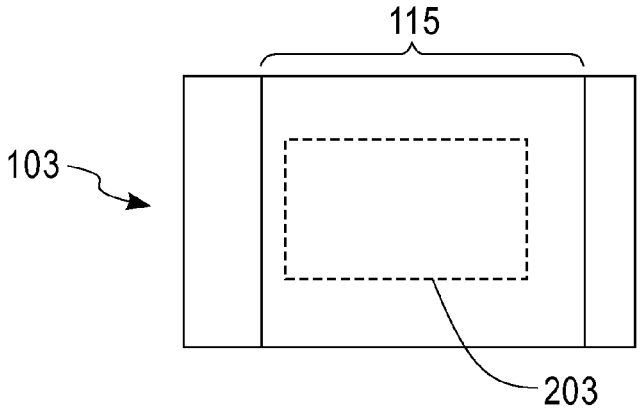
FIG. 3C shows placing the breakable section at the location of a closed graph.

FIG. 3 schematically shows various embodiments in which the RFID tag 103 is divided into at least two sections by the breakable section. The specific manner of dividing can be achieved by placing the breakable section 203 at the location of a straight line shown in FIG. 3A or at a curved line shown in FIG. 3B. The cut line is not limited to the middle of the RFID tag, but can also be located at other locations as long as it can cross the circuit section 115 of the RFID tag. The breakable section can also be located at the location of a closed graph shown in FIG. 3C, so that the RFID tag is divided into a first section surrounded by the closed graph and a second section outside the closed graph. The closed graph is not limited to a rectangle shown in FIG. 3C. The closed graph can be any other geometric shape.

In many fields, such as customs declarations of imported cars, legal documents, top-secret documents, cultural relics, etc., there are significant objects that need to be safe-kept. Loss or mislaying of these objects can result in serious expense and consequence. In some cases, it is necessary to remove the damaged RFID tag without pollution or damage to the surfaces of the object. Therefore, the present application further provides a monitoring method using the above-described RFID tag gripper device.

Figure 4:
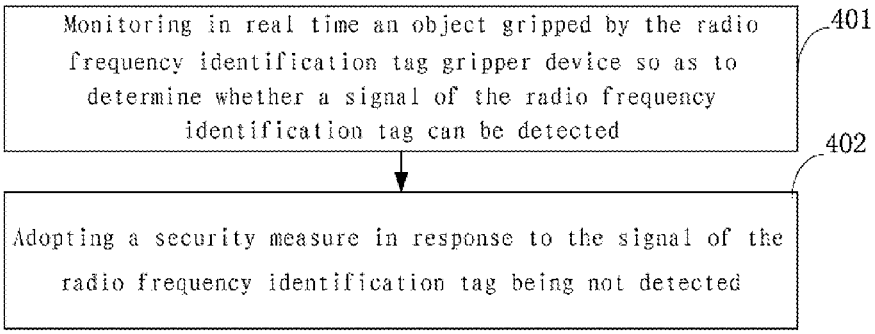
FIG. 4 shows a monitoring method using a radio frequency identification tag gripper device according to an embodiment of the present application.

FIG. 4 illustrates a monitoring method using the RFID tag gripper device implemented by a computer according to an embodiment of the present application.

In Step 401, an object gripped by the RFID tag gripper device is monitored in real-time in order to determine whether the signal of the RFID tag can be detected. In this step, the real-time monitoring of the RFID tag can be executed by periodic scanning. The RFID tag is damaged when there is an attempt to remove the RFID tag mentioned above. Therefore, it can be found in real-time, during the monitoring process, that the signal of the RFID tag cannot be detected and the process then proceeds to Step 402.

In Step 402, a security measure is adopted in response to the signal of the RFID tag not being detected. The security measure can be an alarm, for example.

Taking the customs declaration as an example, the customs declaration is a key part of the capital chain in a car business. Safe-keeping of the customs declaration is very important because banks generally issue credit with a customs declaration as a guarantee. It is necessary to avoid the risk of the customs declaration being stolen or used to apply for credit without permission. Using an RFID tag gripper device shown in FIG. 1, FIG. 2 or FIG. 3, one or more customs declarations are mounted with the gripper device according to the present disclosure and put into a coffer with an RFID tag monitor and the method shown in FIG. 4 is applied, by which the existing distribution and maintenance flow of import customs declarations can be optimized. Therefore, a visual management system of the custom declaration lifecycle and abnormal event alarm can be provided and a credit flow of imported cars can be monitored by the dealer.

Figure 5:
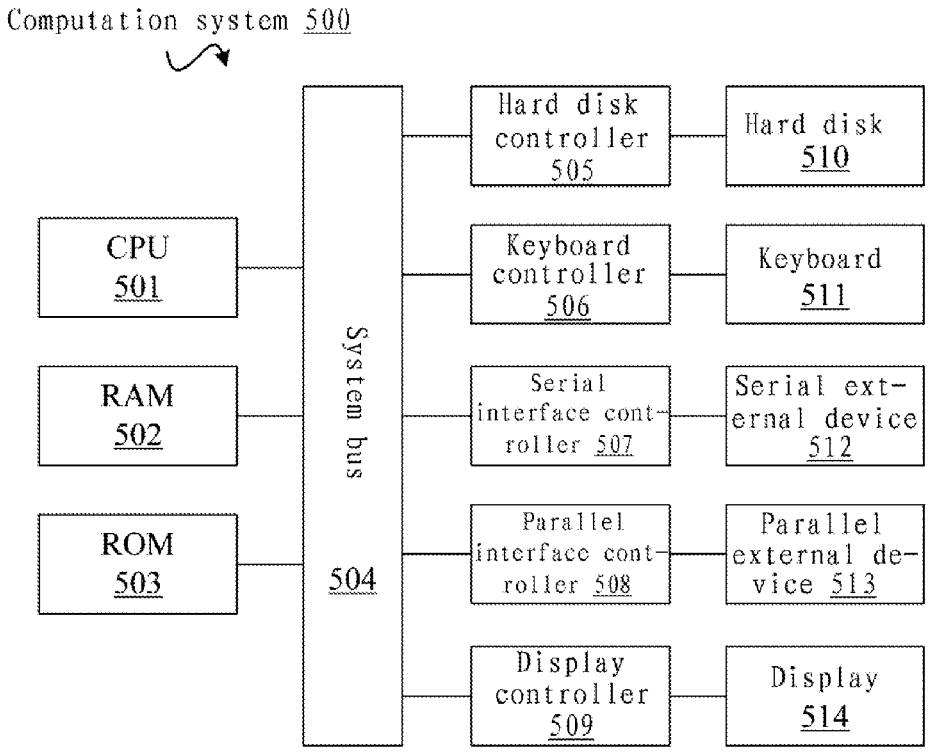
FIG. 5 shows a block diagram of an exemplary computation system, which is used to achieve the implementation of an embodiment of the present invention.

FIG. 5 illustrates a block diagram of an exemplary computation system 500, which is appropriate for achieving the implementation of the present invention shown in FIG. 4. As illustrated in FIG. 5, the computation system 500 can include: a CPU (central processing unit) 501, a RAM (random access memory) 502, a ROM (read-only memory) 503, a system bus 504, a hard disk controller 505, a keyboard controller 506, a serial interface controller 507, a parallel interface controller 508, a display controller 509, a hard disk 510, a keyboard 511, a serial external device 512, a parallel external device 513 and a display 514. Among these devices, the CPU 501, the RAM 502, the ROM 503, the hard disk controller 505, the keyboard controller 506, the serial controller 507, the parallel controller 508 and the display controller 509 are coupled with the system bus 504. The hard disk 510 is coupled with the hard disk controller 505, the keyboard 511 is coupled with the keyboard controller 506, the serial external device 512 is coupled with the serial interface controller 507, the parallel external device 513 is coupled with the parallel interface controller 508 and the display 514 is coupled with the display controller 509. It should be understood that the structural block diagram shown in FIG. 5 is only for the purpose of illustration and not limiting of the scope of the present invention. In some cases, some devices can be added or canceled according to specific conditions.

Although the device and various aspects of the present invention have been hereinbefore described in detail with reference to particular embodiments, the present invention is not limited thereto. Those with ordinary skill in the art can make various changes, modifications and alterations to the present invention without departing from the spirit and scope of the present invention under the teaching of the specification. It should be understood that all of the changes, modifications and alternatives still fall into the protected scope of the present invention. The protected scope of the present invention is defined by the attached claims.

The invention claimed is:

1. A radio frequency identification tag gripper device, comprising:

a first gripper portion having a first grip surface;

a second gripper portion having a second grip surface, the second gripper portion configured to couple to the first gripper portion for the purpose of gripping an object;

a radio frequency identification (RFID) tag having a circuit portion divided into at least a first section and a second section, the first and second sections each having an upper surface and a lower surface;

wherein the upper surface of said first section is coated with a first glue for bonding the upper surface of the first section to the first grip surface when the first gripper portion is coupled to the second gripper portion; and wherein said lower surface of said second section is coated with the first glue for bonding the lower surface of the second section to the gripped object when the first gripper portion is coupled to the second gripper portion.

2. The device according to claim 1, wherein said lower surface of said second section is directly bonded with a surface of said gripped object when the first gripper portion is coupled to the second gripper portion.

3. The device according to claim 1, further comprising a slice of material with one side being coated with a second glue for bonding the slice of material to a surface of the gripped object, the second glue weaker than the first glue, and wherein the bonding the lower surface of the second section to the gripped object comprises bonding the lower surface of the second section to the slice of material and further bonding the slice of material to the gripped object.

4. The device according to claim 3, wherein the viscosity of said second glue is 300-600 cps.

5. The device according to claim 1, wherein said first grip surface of said first gripper portion comprises a groove which accommodates the radio frequency identification tag when the first gripper portion is coupled to the second gripper portion.

6. The device according to claim 1, wherein the circuit portion of the radio frequency identification tag is divided into said first section and said second section by a breakable section, the breakable section weaker than the first section and the second section.

7. The device according to claim 6, wherein said breakable section is configured as a straight line, a curve or a closed geometric shape.

8. The device according to claim 1, wherein the viscosity of said first glue is larger than 1000 cps.

9. The device according to claim 1, further comprising:

a gripping force facilitator configured to couple the first gripper portion to the second gripper portion.

10. The device according to claim 9, wherein the gripping force facilitator is selected from the group consisting of:

an elastic material in contact with the first gripper portion and in further contact with the second gripper portion, the elastic material generating the gripping force upon removal of an external deforming force applied to the elastic material;

a lock-up device in contact with the first gripper portion and in further contact with the second gripper portion, the lock up device sustaining an external gripping force applied to at least one of the first gripper portion and the second gripper portion; and a magnet creating a magnetic attraction between the first gripper portion and the second gripper portion.

11. A method comprising:

monitoring an object in real time, a radio frequency identification (RFID) tag attached to the object with an RFID tag gripper device, the RFID tag gripper device configured to damage a circuit portion of the RFID tag if the RFID tag gripper device is removed;

determining, based on the monitoring, whether a signal of said radio frequency identification tag is detected; and adopting a security measure in response to the signal of said radio frequency identification tag not being detected.

12. The method according to claim 11, wherein the circuit portion of the radio frequency identification tag is divided into a first section and a second section by a breakable section, the breakable section weaker than the first section and the second section.

13. The method according to claim 12, wherein said breakable section is configured as a straight line, a curve or a closed geometric shape.

14. The method according to claim 11, wherein the object is selected from the group consisting of:

a customs declaration of an imported car;

a legal document;

a top-secret document; and a cultural relic.

* * * * *